United States Patent [19]

Anthony

[11] 4,130,474

[45] Dec. 19, 1978

[54] LOW-TEMPERATURE OIL SHALE AND TAR SAND EXTRACTION PROCESS

[75] Inventor: Myron L. Anthony, LaGrange, Ill.

[73] Assignee: Shoilco, Inc., Grand Junction, Colo.

[21] Appl. No.: 694,231

[22] Filed: Jun. 9, 1976

Related U.S. Application Data

[63] Continuation-in-part of Ser. No. 570,007, Apr. 21, 1974, abandoned.

[51] Int. Cl.[2] ..... C10G 1/04; C05D 1/00

[52] U.S. Cl. ..... 208/11 LE; 71/31; 71/32; 71/61

[58] Field of Search ..... 208/11LE; 71/31, 32, 71/61

[56] References Cited

U.S. PATENT DOCUMENTS

| | | | |
|---|---|---|---|
| 1,327,572 | 1/1920 | Ryan | 208/11 LE |
| 1,707,759 | 4/1929 | Hampton | 208/11 LE |
| 2,173,842 | 9/1939 | Horner | 208/11 LE |
| 2,431,677 | 12/1947 | Brown | 208/11 LE |
| 2,596,793 | 5/1952 | Schabelitz | 208/11 LE |
| 3,695,354 | 10/1972 | Dilcren et al. | 208/11 LE |
| 3,697,412 | 10/1972 | Brimhall | 208/11 LE |
| 3,941,679 | 3/1976 | Smith et al. | 208/11 LE |
| 4,029,568 | 6/1977 | Pittman et al. | 208/11 LE |
| 4,046,669 | 9/1977 | Blaine | 208/11 LE |

FOREIGN PATENT DOCUMENTS

| | | | |
|---|---|---|---|
| 996485 | 9/1976 | Canada | 208/11 LE |

OTHER PUBLICATIONS

Hawley, G. G. ed, Condensed Chemical Dictionary, 8th Ed., Van Nostrand, Reinhold Co., N.Y., pp. 364 & 668.

*Primary Examiner*—Herbert Levine

*Attorney, Agent, or Firm*—Kinzer, Plyer, Dorn & McEachran

[57] ABSTRACT

Fertilizers and kerogen materials are extracted from crushed oil shale utilizing a low temperature dekerosing (kerogen removal) solvent phase followed by a second fertilizer extraction phase using water as solvent. Process control factors are effective in producing delamination of the crushed oil shale resulting in high yield of kerogen and fertilizer values. The dross shale residue is not disintegrated and constitutes an ecologically acceptable soil conditioner and land restoration residuum. Proper blending of the various extracts and residues result in a wide variety of commercial fertilizer products. Bitumens and fertilizer materials may also be extracted from tar sands of both the hard, stony and soft variety and again a non-petroleum solvent, low temperature extraction process is used in a first step to recover the bitumen fraction. The solvent is totally recovered and recycled. Thermal energies are also recycled resulting in high overall efficiency. The sand residium or dross is clean and uncontaminated, constituting a water wettable land restoration medium with plant nutrient value imparting arable character. A second step may be employed to selectively leach fertilizers, notatably phosphates and potash. Leaching is accomplished by the use of water, which is recovered and recycled.

43 Claims, 9 Drawing Figures fig. 3.
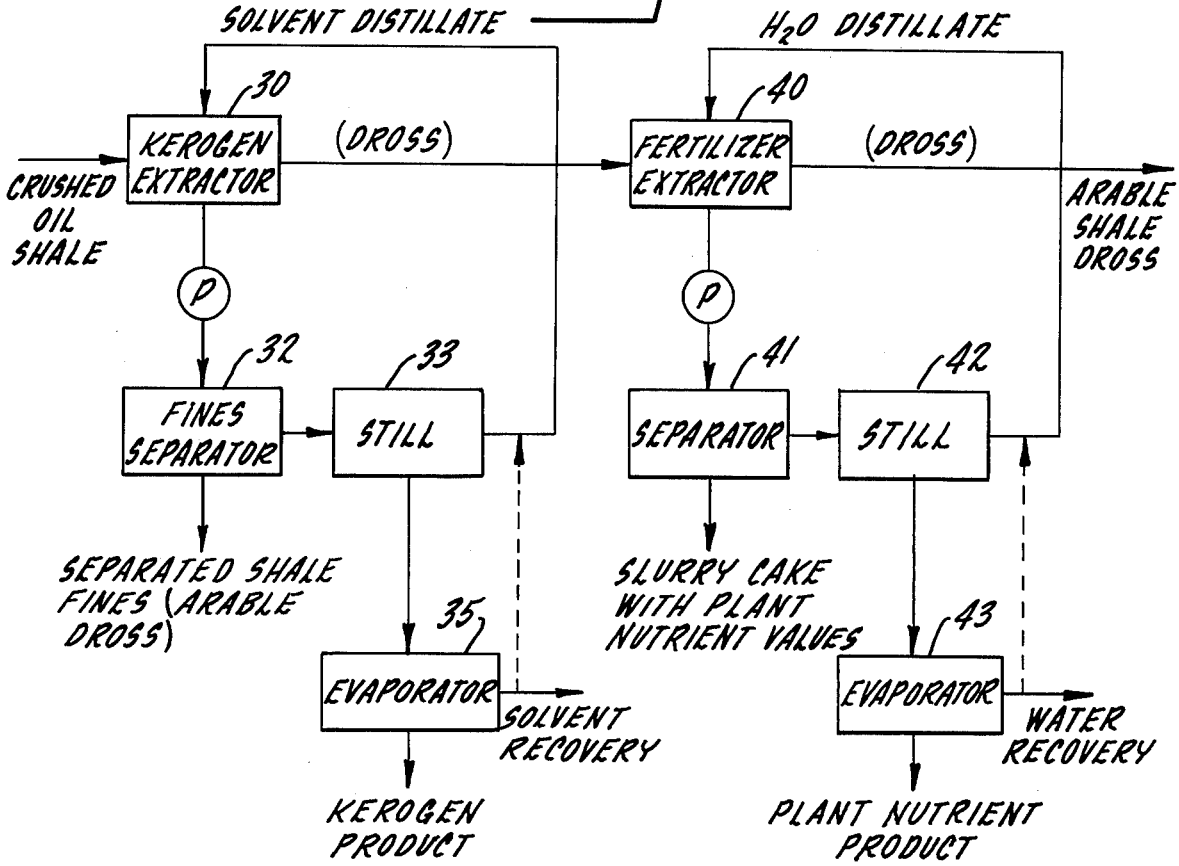
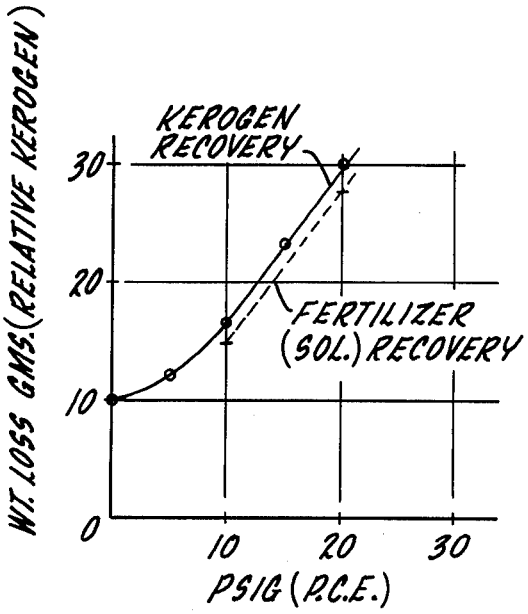
fig. 4.
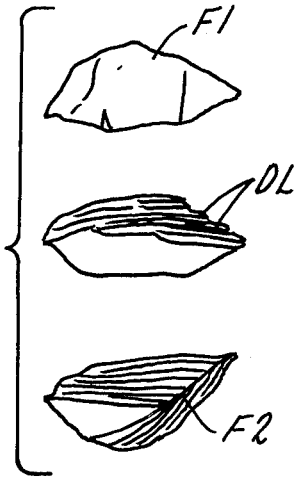
fig. 5.

FIG. 8
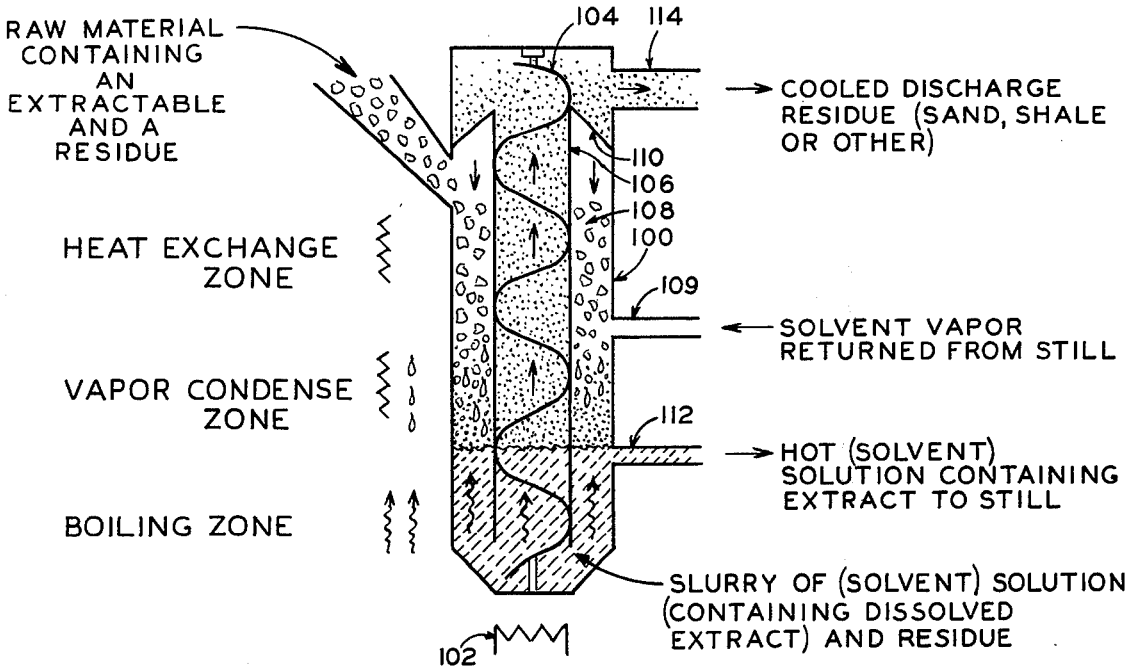
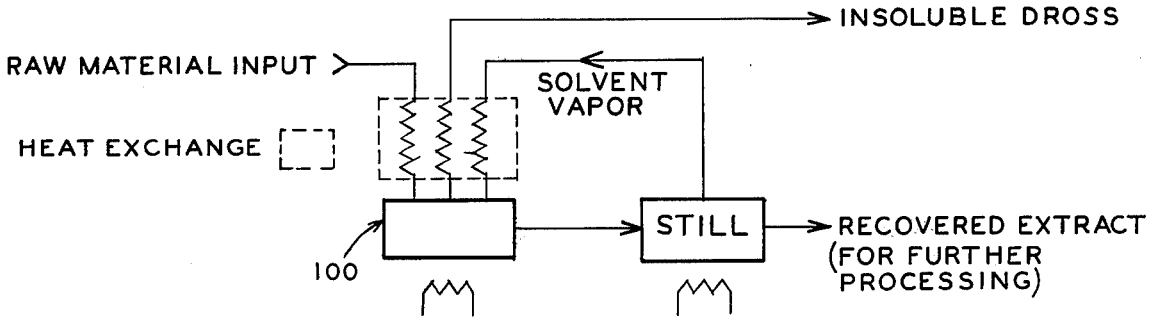
FIG. 9

LOW-TEMPERATURE OIL SHALE AND TAR SAND EXTRACTION PROCESS

CROSS-REFERENCE TO RELATED APPLICATIONS

This application is a Continuation-in-Part of application Ser. No. 570,007, filed Apr. 21, 1975 now abandoned.

The process described here involves the treatment of oil shale to produce an organically rich, granular, water-permeable earth-like material which can be employed as an agricultural substrate to support plant life. This will be termed the substrate product. The substrate is derived by the partial extraction of the entrained organic material, generally called kerogen, from highly compacted sedimentary shale rock. A controllable amount of residual organic material in the treated substrate provides a rich plant nutrient with slow release properties. In producing these substrates the process yields substantial quantities of valuable petrochemicals of the kerogen-hydrocarbon type.

Oil shales are found in trememdous quantities throughout the United States. The rock-like shales of the Green River Formation of the central Rocky Mountains have attracted considerable attention. This area is rich in oil producing shales of high yield value. There are responsible authorities however, who resist the destruction of shale cliffs and mountains of general scenic value for the sake of fuel recovery, particularly if what remains constitutes a strip mine ecology.

The oil shortage of 1973 and the attendant fuel crisis have created interest in the development of new sources of energy and in the eventual attainment of national self-sufficiency. Extensive commercial involvement and the government program "Project Independence" attest to the seriousness and magnitude of this problem.

Many energy recovery systems are currently under investigation. Also, oil exploration and development is being substantially increased. Oil shale is also thought by many to be capable of supplying a substantial portion of the nation's energy requirements. It is estimated there are nearly two trillion barrels of extractable shale oil in the Western states.

At one time, environmental considerations were of little or no consequence in connection with our accelerating development and use of energy. However, many feel today that current environmental wastage or pollution can no longer be tolerated. Stringent legislation has already been enacted in this regard, both at the national and the state level. Future energy recovery programs will have to be planned to conform with Federal and State environmental standards.

Oil shales contain organic materials generically termed kerogen. These shales comprise highly compacted sedimentary rock containing kerogen finely dispersed in inorganic material. The kerogen is wax-like in nature. It renders the otherwise porous shale impervious to water and generally highly impermeable to ordinary hydrocarbon solvents. Using suitable processes, the kerogenous material can be pyrolyzed at high temperatures, above 700° F. converting the kerogen into shale oil, closely resembling crude oil. In the ordinary process, where the effort is as near complete extraction as possible, the shale is disintegrated, resulting in an ash-like residue of considerably expanded volume. This residue crumbles when touched.

The novel process described below involves the extraction of a kerogen fraction from rocky shales with concurrent production of a valuable agricultural substrate, mechanical stable and of high plant nutrient value. The character of this residual material, along with proper control of quarrying and replacement techniques, make possible the restoration, reclaiming, and, in fact, the generation of new agricultural substrates where previously there were none.

The present process also yields valuable petrochemical products in the form of kerogenous materials, substantially unaltered by pyrolysis or destructive distillation.

In addition to the fuel crisis, there are serious raw material shortages hampering industry that are associated with the oil shortage. Petrochemicals are involved in an ever-increasing and important segment of industry. Petroleum-derived fertilizers are of major importance in agriculture and the production of food. This factor alone makes the oil shale utilization program described herein a subject of considerable economic importance.

The kerogen in oil shale is generally believed to be derived from spores, pollen, algae filaments, and other plant or animal remains geologically developed some 40 to 50 million years ago. The word "kerogen" is derived from the Greek word for wax. The shale also contains large amounts of inorganic minerals such as aluminum silicates and more specifically quartz, feldspar, clay, dolomite and calcite.

Methods for the extraction of oil from oil producing shales have been the subject of extensive investigation for many years. Generally speaking, the methods have involved one of two basic approaches, or a combination of both. The first utilizes a "retorting" operation wherein the oil shale is crushed and placed in a retort where it is heated to a high temperature, somewhere in the range of 700° to 1500° F. Most processes center at about 900° F. Reaction heat is usually supplied by burning the residual spent shale or some of the oil product derived from the process.

The second basic technique has been to "digest" the crushed shale in very hot solvents, generally petroluem solvents, that are recycled from the process. Extraction temperatures employed may be in the 700° to 1500° F. range. Numerous schemes are utilized to separate the shale oil produced by the process from the solvent and from inorganic shale material. Separation is difficult because of the very fine ash-like dross, hereinafter identified. This dross also complicates retorting. As in the case of retorting, the shale oil is subjected to further processing steps more-or-less comparable to usual refining and fractioning methods. U.S. Pat. No. 2,431,677 is in some respects typical of known methods for extracting kerogen by digesting the shale in very hot solvents, to convert the kerogen to soluble hydrocarbons and fixed gases. The onset of conversion commences at about 400° F. (there is some evidence of conversion of 350° F., Table 1) and complete conversion commences at about 710° F. Higher temperatures are necessary to obtain higher fractions. Under the conditions of digestion, exfoliation of the shale particles takes place, reducing the shale "to a very fine carbonaceous residue" necessary to assure "complete removal of the oil therefrom" as stated in the patent. The residue, treated at 500° C., is so fine it may be employed as an adsorbent (not an absorbent). This confirms any experience which is that at about 700° F. and upwards the dross resulting from complete oil extraction at high temperature is as fine as dust under a mere touch; bioactive materials are also produced. It cannot possibly be used for agricultural purposes; it is non-arable.

Both of the generally known methods frequently utilize very high pressures, some as high as 5000 pounds per square inch. Both methods also yield approximately the same shale oil products, these being shale oil, fixed gases, condensible gases, and a coke or char residue in the spent shale. A generally used measure of oil shale extraction efficiency is a standarized procedure known as the Fischer analysis.

It has been found that most oil producing shales, when subjected to this Fischer analysis, yield up their hydrocarbonaceous energy content in the following ratio:

Oil — 69%
Gases — 11%
Coke — 20% (spent shale residue)

Some processes that utilize catalysts and high pressure have resulted in oil yields greater than the Fischer analysis.

In nearly all of the conventional extraction methods the rocky shale mass is disintegrated so much so that the natural porosity of the shale, resulting from digestion of the kerogen, is at the same time destroyed. The resulting spent, sterile shale has the characteristic of a light ash-like material, greatly expanded in volume, and containing some carbonaceous residue. The amorphous, ash-like character of this residue makes in-situ replacement virtually impossible. Also, when wet the residue consolidates into an impervious, clay-like mass which is not self-aerating and for this reason alone is inimical to plant life in the practical sense.

The National Science Foundation has issued a report dealing with the ecological aspects of high temperature reacted spent shale (NSF Gl 34282X1). The report presents to results of tests showing that spent shale dumps contains substantial quantities of inimical biologically active polycyclic and polynuclear hydrocarbon materials that would eventually translocate and find their way into the ecological food chain. These result from high temperature, and the reactions between the kerogens and inorganics. The report also indicates that five known carcinogenic compounds have been identified in these spent reacted shales.

The known methods of shale oil extractions, involving high temperatures, have other drawbacks. The equipment is expensive and costly to maintain. The disposal of enormous quantities of spent shale, amounting to thousands of tons per day from typical plants, would further increase the cost. The high temperatures involved result in low thermal efficiency and energy losses which increase exponentially with increasing temperatures. Water consumption is especially high. As noted before, the high temperature processing of the shale causes it to expand substantially in volume and the result is an ash-like dross. Reclaiming and replacing this amorphous dross, in a manner consistent with current ecological requirements present very serious, if not insurmountable, problems.

At the present time, there does not seem to be a realistic solution to the problem of dealing with high-temperature processed shale residue. Environmental problems associated with restoration and biologically active materials seem to preclude the possibility of using oil shale as simply a source of fuel.

Alternative shale oil processes, expected to be more environmentally acceptable, have been under investigation for some years. Several major oil comprises are currently involved in substantial efforts in this regard, especially in the Colorado area. These alternative methods generally involve an in-situ process wherein various elements are employed to extract shale oil from deep strata, using hot digestive solvents or other pyrolytic techniques. Nuclear blasting is being considered in this respect; objections naturally prevail.

The low temperature process outlined herein for the partial extraction of kerogen, (organics generically, that is) is a radical departure from previous methods. It involves low temperatures in a solvent phase, preferably a vapor-solvent sequence. The system is basically self-recycling and, by the careful use of closed thermal loops, high thermal efficiency may be achieved. The principal atmospheric output is heat, and that is minimal. Processing temperatures are maintained well below the point (about 700° F.) where the shale commences to exfoliate or disintegrate; thus, the spent shale dross is essentially unaffected in volume, other than the volume density change resulting from the crushing operation. It is also generally unchanged in its mechanical properties; it exhibits porosity and retains a solid granular or soil-like characteristic, which in combination with other properties results in a valuable and manageable substrate suitable for agricultural and land reclamation uses.

Climatic conditions throughout much of the central Rocky Mountain shale fields will support the production of row, fruit crops, and ground cover where a suitable soil substrate and an appropriate water source is available. The extraction process outlined here is well suited to take advantage of this fact. Since the recovered shale dross can be replaced more or less in its original site or placed in other suitable sites, and the partial removal of the kerogen leaves it with good water permeability and plant nutrient value, its agricultural use can be seriously considered.

In this connection it should be noted that the scant annual rainfall throughout much of the potential shale oil areas occurs in a few episodes that result in heavy runoff, flash floods, and little or no water retention. A non-porous, fine, ash-like dross would only exacerbate the prevailing conditions. Under the present invention the low temperature vapor extracted shale dross may be employed for land reclamation so as to entrain and utilize this valuable but wasted rainfall. The substrate product, being mechanically stable, is easy to manage in a spreadable sense, as compared to peat and spagnum mosses, Vermiculite, and other such common potting and soil conditioning media.

Some of the major factors contributing to the outstanding agronomy characteristics of the present agricultural substrate product can be attributed to the following:

(a) The dross material contains unreacted inorganic material with plant nutrient value.
(b) Removal of the bulk kerogen leaves the material porous and with good water absorption properties.
(c) The pH is in the 6.0 to 8.0 range and self-buffering properties are exhibited.
(d) The dross material contains nitrates, potash, phosphate and inorganic minerals, apparently in a favorable range.
(e) The material exhibits good anti-mold and mildew properties.

Like kerogen itself, there is some uncertainty about the organic residue in the dross. It may be at least in part kerogen. However, the dross also retains a water soluble organic fraction which can be leached with boiling water. It has fertilizer value in the form of phosphates, nitrates and potash, which are water leachable from the dross. Depending, then, on the quality and quantitative value of the dross, a fertilizer product can be extracted with water.

The objects of the invention are to develop a process for production of an oil-shale-derived water-permeable agricultural substrate containing a residue of a substantially unreacted inorganic material which will support plant life; to orginate a solvent process for partially extracting kerogen from oil shale without destructive distillation and without applying a temperature so high that the shale is split, fractured, expanded or exfoliated to an extent where its porosity is lost and its granular character destroyed; to obtain a natural organic fertilizer from oil shale by selective removal of kerogen without materially altering, and certainly not reacting, any inorganic residue; and to create agricultural substrates from wasteland shale oil deposits concurrently with extraction of the kerogen content, both exploiting a natural wasteland environment and generating a biological supportive environment.

FIG. 3 is another flow charge for oil shale;

FIG. 4 shows yield vs. pressure;

FIG. 5 shows a shale particle;

FIG. 8 shows schematically a heat exchange extractor; and

FIG. 9 is a diagrammatic view of the heat exchange principles.

Figure 1:
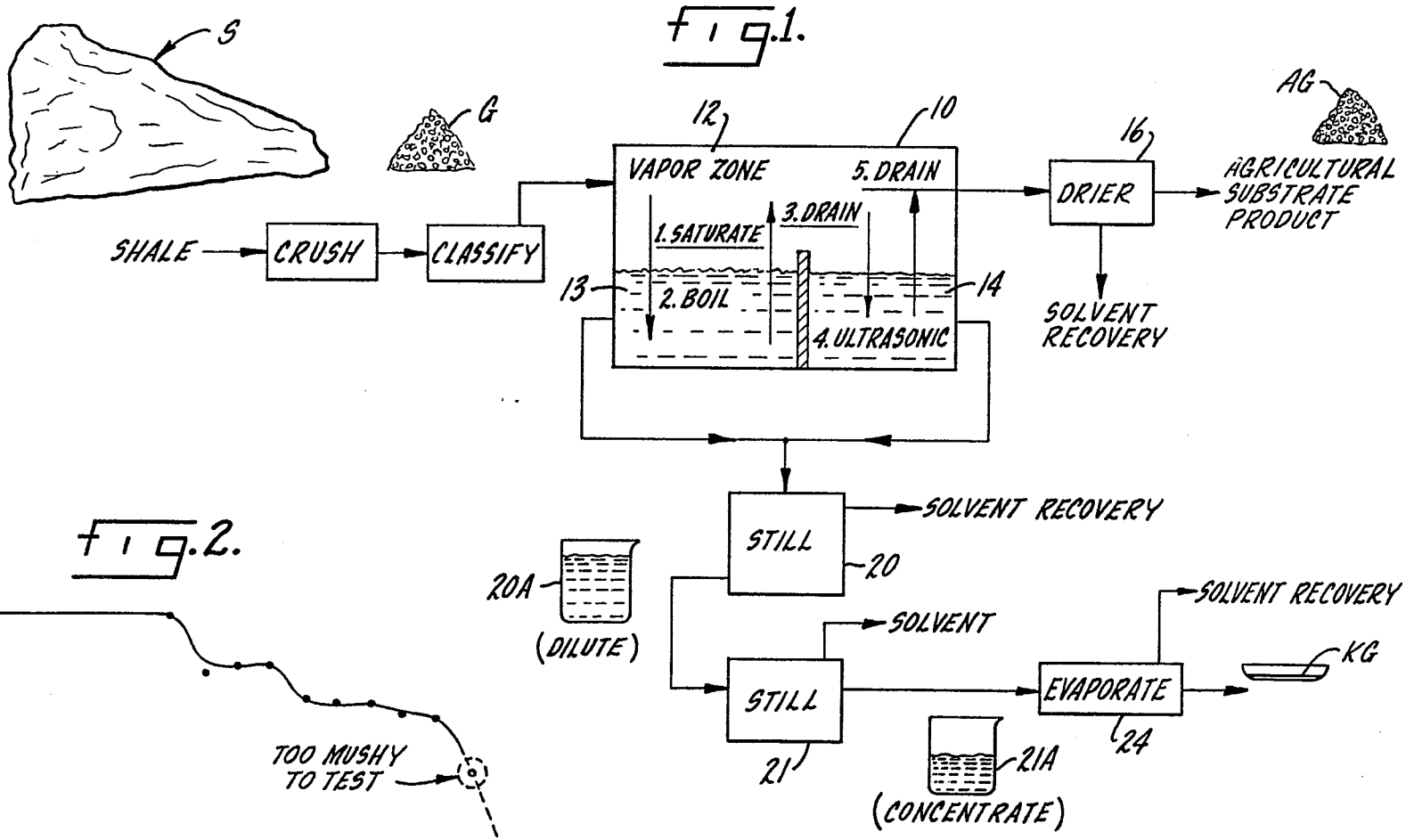
FIG. 1 is a flow chart for oil shale.

A process for maintaining the mechanical integrity of a finely divided kerogen-containing rock, a so-called oil shale, suitable for use as an agricultural aggregate, while extracting kerogen, is set forth in FIG. 1. The shale S, as quarried, or mined, is crushed and classified to granular form G predominately of 1/16–⅛ inch screen size. This is also substantially the grain size of the extracted, agricultural substrate product AG.

The granular shale G is subjected to low temperature solvent extraction for partly extracting the kerogen. This may be accomplished within a closed housing 10 having a vapor chamber 12, a chamber 13 containing a boiling solvent, and a chamber 14 in which the same solvent is under ultrasonic agitation. The granular material may be delivered by a conveyor or screen belt.

The granular shale G is preferably first suspended in the vapor chamber 12 for the purpose of gradually raising its temperature from the ambient as-classified condition. By doing so, the temperature of the boiling solvent is not substantially reduced when the batch to be extracted is submerged. In the vapor zone in chamber 12, the solvent vapors are constantly condensing on the granular shale, which may be supported in a porous basket or on a vapor and liquid permeable conveyor.

As noted above, kerogen (as distinguished from its conversion product) is not highly soluble in ordinary hydrocarbon solvents. The solvent in chamber 13 may be one of several commercially available solvents capable of leaching kerogen, including perchloroethylene ($C_2Cl_4$) having a boiling point of 250° F.; trichloroethylene ($C_2HCl_3$) having a boiling point of 188.4° F.; and some Freon materials having boiling points as high as 188° F. Perchloroethylene is extremely inert and except under unusual circumstances will not react chemically, even in the presence of fuming sulfuric acid.

After the granular shale has been virtually saturated in the vapor chamber 12, during which time some kerogen is dissolved, the shale is lowered into chamber 13 where the major extraction process occurs, at a temperature considerably below the temperature where any appreciable fracturing of the granular shale occurs due to thermal expansion and at a temperature far below the temperature which characterizes substantially complete conversion of the kerogen.

Figure 2:
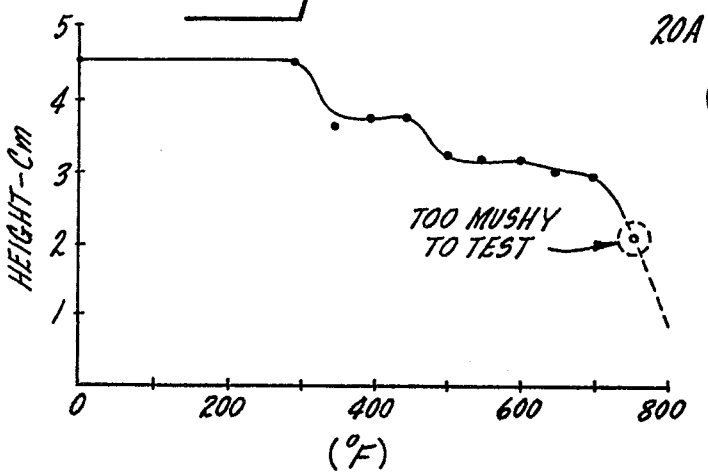
FIG. 2 shows the effect of temperature changes on the mechanical properties of oil shale.

In this connection, attention is directed to FIG. 2 of the drawing, showing fracture tests performed on a black shale mined near Grand Junction, Colorado and containing about 30 gallons of shale oil per ton. This is a typical commercial grade oil shale. Particles of the granular shale, each of uniform screen size (¼ inch) were maintained for 30 minutes at the temperatures marked on the fracture curve. Granules for test, at the temperature shown on the curve, were then subjected to impact testing, using a 2 pound weight. The height when the weight pulverized the granules was plotted. It will be seen that the resistance to impact remained the same up to 300° F. thereafter diminished and stayed substantially constant up to 450° F. and then declined again at 500° F. At temperatures in excess of 700° F. the granules were so fragile that further testing was meaningless.

The following observations were made during the destructive testing of the granules:

TABLE 1

| | |
|---|---|
| Test Conditions: | |
| Grand Junction, Colorado, Black Shale (30 gallon yield) | |
| ¼ inch screen | |
| Maintain at temperature for 30 minutes | |
| Partial reducing atmosphere (vented chamber) | |
| 300° F | Detect petroleum odor. |
| 350° F | Slight petroleum odor. |
| 400° F | Strong petroleum odor (onset of conversion). |
| 450° F | Smoke and strong odor. |
| 500° F | Smoke and strong odor. |
| 550° F | Smoke and oil residue. |
| 600° F | Heavy oil residue. |
| 650° F | Heavy oil residue. |
| 700° F | Distillate at vent. |
| 725° F | Self reaction (heating). |

This test data at about 700° F. corroborated the test data set forth in column 2 of U.S. Pat. No. 2,487,788 to the effect that appearances of the complete conversion of kerogen to bitumen commence at about 707° F. the percentage of conversion increasing with time at temperature:

TABLE 2

| | 0.5 hrs. | 1.0 | 1.5 | 2.0 |
|---|---|---|---|---|
| 707° F (375° C) | 6.9% | 13.4 | 19.4 | 25.0 |
| 752° F (400° C) | 22.1 | 39.4 | 52.8 | 63.2 |
| 797° F (425° C) | 51.8 | 76.8 | 88.8 | 96.0 |

Digestion of kerogen, while concurrently exposing shale granules to the same temperature during the digestion process (see U.S. Pat. No. 2,431,677), is to be distinguished from the low temperature solvent extraction process of the present invention where the extracted kerogen will subsequently be processed for petrochemical use or converted at a high temperature to obtain the usable bitumen content.

The data in FIG. 2 corroborates the statement in U.S. Pat. No. 2,431,677 that when the temperature conditions are such, in a hot solvent medium as to effect complete removal of oil from shale by solvent digestion, the shale at the same time will undergo "exfoliation" and become reduced "to a very fine carbonaceous residue" which is precisely the "mushy" state in FIG. 2 where the residue after treatment at 700° F. is so fragile it crumbles under a light touch between the thumb and forefinger, completely incapable of being managed as an arable material. In the presence of moisture it becomes a gummy clay-like mass.

Returning to the present process, the boiling point of the solvent in which the shale granules are being treated, rises as more and more kerogen is extracted, but at no time it is permissible under the present invention to allow the boiling point to rise above a temperature of 700° F. To be on the safe side, to assure incomplete kerogen extraction, to maintain the mechanical integrity of the shale granules, and to prevent reaction of the kerogen residue likely to result in inimical polycyclic chemicals, the temperature of the boiling solvent should not be allowed to exceed 400°–500° F. Above that temperature, FIG. 2, thermal destruction of the shale granules is on a progressively declining slope. Even so, by restricting the solvent extraction temperature to 300° F., a typical solvent end point, or less, the fixed gas fraction (see Table 1) will not be entrained in the solvent vapor to any appreciable extent, but will be leached into the boiling and vaporized solvent.

In general, 50–75% of the kerogen content, under the present invention is extraced in the vapor-liquid process after 15–50 minutes using perchlorethylene; the boiling point of the kerogen-solvent mixture generally will not exceed 275° F. when using perchlorethylene.

The leached shale, in FIG. 1, in the next step is elevated to the vapor space. Entrained solvent is allowed to drain back to the hot solvent in chamber 13.

Kerogen, loosened by the solvent, can be recovered by next transferring the treated batch to a chamber 14 containing clean, hot solvent under ultrasonic agitation. This treatment, in effect, shakes out the residual kerogen content which was partly loosened by the treatment in chamber 13 and prevents loss of that loose kerogen fraction which might be wasted in the subsequent drying episode.

Following ultrasonic separation, the shale is again elevated to the solvent vapor chamber, where all liquid solvent is removed and then transferred to a drier 16 where residual solvent is recovered, resulting in the arable product AG, FIG. 1. The agricultural substrate material AG is porous as a result of extracting the kerogen. The dross AG is found in most instances to contain a water soluble fertilizer constituent, easily leached by water.

Thus, granules AG of ⅛ inch screen size yield a fertilizer constituent up to 4.6% by weight. Similar granules AG of ¼ inch screen size yield 1.24% (total) by weight of the fertilizer constituent. The constituent contains potash, nitrates, phosphates and trace minerals. Heavy, toxic metals such as mercury and cadmium fall below a 0.0 ppm limit, deemed acceptable. This is probably due to the low temperature extraction process which leaves such heavy metals in their insoluble, entrained or combined form. The yields were obtained merely by soaking the granules in water at room temperature for 24 hours. Larger percentages are obtained using hot water. It will be seen from these data that the process can be selectively modified, in terms of water temperature and screen size, to vary the fertilizer content in the final substrate material AG. Further study may be required to determine more precisely the optimum, unleached fertilizer residue to be retained in a given final agricultural substrate. Water solutions of the fertilizer constituent shows a pH in the range of 6 to 8.

The development of porosity is inherently due to extraction of the kerogen. This not only enables moisture to be retained by capillarity, it also enables atmospheric oxygen and nitrogen to be adsorbed which is quite desirable to support good plant growth. Seeds were potted in the treated shale granules AG from which no fertilizer constituent was leached: red cabbage, Italian rye (a very hardy plant), Kentucky Blue grass, and Sugar Maple seedlings. The cabbage sprouted 2 days later, the Italian rye 3 days later. In 4 days, new leaves appeared on the maple seedlings. The Kentucky Blue grass sprouted in six days, and on that day the cabbage plants had attained a height of 2–3 centimeters, the Italian rye 5–7 centimeters; the maple seedlings continued to grow. In 12 days, the Italian ray had attained a height of 15 centimeters.

This growth is to be compared to Italian rye seeds planted at the same time in a shale dross subjected to high temperature destructive heating at 900° F. It sprouted in 2 days and in 5 days had attained a height of only about 1 centimeter, attributable to the energy stored in the seeds themselves, because shortly afterwards the seedlings died. In 5 days, the Italian rye planted in the agricultural substrate of the present invention had attained a height of about 3 centimeters.

All seeds and plants were grown in 2 inch pots, bottom watered daily. For those planted in the agricultural substrate of the present invention, the germination rate was in excess of 85%; for the Italian rye planted in the high temperature dross (900° F.) the germination rate was less than 5%.

Referring again to FIG. 1, the separated, dissolved fractions of kerogen are distilled, preferably in multiple stages in two stills 20 and 21. The kerogen concentration is increased in stages, 20A and 21A. The concentrated solution, 21A, is finally subjected to evaporation (stage 24). The product, the extracted kerogen KG (collected in a Petrie dish, FIG. 1) is a black (or dark brown) tar-like solid from which soluble hydrocarbon fractions can be obtained.

In summary, there is no attempt to separate the kerogen fraction by digesting the crushed shale at a high temperature which characterizes complete kerogen removal. To the contrary, there is a kerogen residue in the treated shale granules AG and this organic residue renders those treated granules arable. The kerogen residue is neither reacted with nor catalyzed by inorganic material residue in the shale, such as aluminum silicates or iron, likely to originate carcinogenic or mutenogenic by-products of inimical character. The environment is not merely restored or rejuvenated, it is purposely rendered arable and where desired restructured. Even if there is no attempt at the quarry site to plant seeds, the arable product AG will obviously germinate seeds which are distributed by natural processes, whch is to say that natural ground covers can rapidly encroach a substrate restored site.

The extent of crushing is a matter of agricultural choice (screen size) and an economic trade. The finer the aggregate the more efficient is the extraction process, but the more expensive the crushing. Screen sizes generally follow a curve of distribution, that cannot be avoided except at greater expense. Oversize and undersize fractions are tolerable within limits. An acceptable yield from screening is as follows:

TABLE 3

| Screen Size (mesh) | % by Weight |
|---|---|
| 1/2 | 9.7 |
| 1/4 | 41.3 |
| 1/8 | 27.2 |
| 1/16 (+ fines) | 21.8 |

In the process described above the sequence of exposure within housing 10 is: (1) vapor, (2) liquid boil, (3) drain, (4) ultrasonic scrub, (5) drain and dry. But there are many sequences possible, all within the material air of partly extracting kerogen in a controlled amount. It has also been found that the extracted kerogen mixed with the solvent contains some of the water soluble fertilizer constituent. This constituent can be separated by agitating the concentrated product 21A with water or steam until an emulsion is formed. The emulsion can be broken by heating it. The kerogen fraction in the solvent separates as a subnatant; water containing the fertilizer floats as a supernatant. Steam can be used in lieu of hot water to obtain the supernatant.

The kerogen obtained by the present low temperature solvent extraction process is unique in its nitrogen and sulfur content. The Bureau of Mines reports the percentage of nitrogen in kerogen obtained by retorting shale is 2.2%. Under the present process, when the temperature does not exceed 450° F., the nitrogen content of the extracted kerogen is only 1.08%.

The yield of pyrolytically unaltered kerogen (that is, kerogen not converted or fractionally distilled) extracted from crushed oil shale by the low temperature solvent extraction process, and subsequent yield of the fertilizer constituent retained in the dross, can be increased by operating above atmospheric pressure sufficiently to delaminate the crushed shale particles subjected to the action of the hot solvent. Cracks or rents develop at the edges of the granules, opening the interior. Consequently, more surface area is exposed for solvent action, both during extraction of kerogen and subsequent extraction of the fertilizer values. The delamination process is mild; it does not destroy the mechanical strength of the granules, rendering them useless as an agricultural substrate, even though sub-division occurs, and is to be distinguished from the phenomenon of disintegration which characterizes the destructive process heretofore used.

Referring to FIG. 3, the crushed shale is delivered to the solvent extractor vessel 30, operating on the principle described above, except in this instance the vessel is sealed. Consequently, as the extraction process proceeds (using perchlorethylene as the solvent for example) the pressure is allowed to increase to about 10–20 pounds per square inch gauge (10–20 psig). The effect is to raise proportionally the boiling point of the perchlorethylene, to about 310° F. (at 15 psig) compared to the process illustrated in FIG. 1 where no attempt is made to impose a pressure above atmospheric in the extraction chamber.

Using crushed shale principally of ¼ to ½ inch size, it is found the shale granules delaminate in the course of solvent extraction; they open like pages of a book, resulting in thin planar granules which not only increase yield but also eliminate the cost of crushing to smaller size, say to ⅛ to 1/16 inch screen size, or smaller. Nonetheless, the thin plates retain substantially the original hardness and crush resistance deemed of importance for land reclamation.

After extraction, the solvent which contains the kerogen extract is pumped to a separator 32 (either centrifugal or filter) to strip any shale fines entrained in the solvent. The stripped solvent is delivered to a still 33 where a large portion of the solvent is distilled for return to the extractor chamber while the remainder of the solvent kerogen concentrate is delivered to an evaporator 35, operating on either vacuum or thin-film principle. At the evaporator, the dissolved kerogen is collected and the solvent is recovered.

Extraction is complete after about fifteen minutes to one hour, depending on several variables: temperature/pressure; size, and solvent concentration. Thus, as the solvent becomes more concentrated in its kerogen content, its efficiency becomes less, so that under some circumstances, there is an advantage to draining solvent from the extractor and subjecting the retained batch of partially extracted shale to an influx of fresh solvent.

Assuming partial extraction of kerogen from a given batch of shale to be completed, the shale dross containing the fertilizer residue is transferred to the fertilizer extractor 40 which may be structurally similar to the solvent extractor. Here, however, the extracting medium is simply hot water which leaches the fertilizer constituent as a matter of time exposure. A mild pressure is preferably maintained in the fertilizer extractor, up to 20 psig. The small amount of retained solvent is also recovered in this operating step.

The water, bearing the leached fertilizer partly suspended and partly dissolved, is pumped to a separator 41, which separates a fertilizer concentrate of paste-like or slurry form. The separated water phase contains fertilizer values in true solution and is transferred to a still 42 where pure water is distilled and returned to the fertilizer extracting chamber, leaving a concentrated fertilizer solution. This concentrated solution is transferred to an evaporator 43 where all remaining water is recovered along with the water soluble fertilizer values is somewhat crystalline form.

In accordance with the present invention, not all the inorganic content of fertilizer value in the shale dross is removed at the fertilizer extractor. A fraction is retained in order that the dross will possess an arable character, suitable as land fill capable of supporting plant life. This dross may be combined with the first dross fines recovered at separator 32, or each may be separately exploited in terms of slightly different arable merit; they may be buttressed by the fertilizer values recovered at separator 41 or evaporator 43. The word "dross" is employed in the present context in the sense of "remains" or "residue".

Increased kerogen yield and fertilizer yield is evident from the data set forth in Table 4. Each sample for testing was dried to remove surface moisture and weighed to 500 grams (¼ inch screen size). All conditions were equal (using perchlorethylene for 45 minutes); only the pressure was varied.

TABLE 4

| Test No. | Recovery Kerogen | (grams) Fertilizer | Pressure | (and Temp° F)* |
|---|---|---|---|---|
| 4 | 10.0 | | Atm. | (252°) |
| 5 | 11.0 | | 5 psig | (270°) |
| 6 | 16.4 | (15.0) | 10 psig | (287°) |
| 8 | 24.0 | | 15 psig | (310°) |

TABLE 4-continued

| Test No. | Recovery Kerogen | (grams) Fertilizer | Pressure | (and Temp° F)* |
|---|---|---|---|---|
| 9 | 30.0 | (28.5) | 20 psig | (325°) |

*Temperature in the kerogen extractor; same pressure employed during leach with water at the boiling point.

The data set forth in Table 4 are plotted in FIG. 4. The kerogen yield increases proportionally with applied pressure during the extraction process and as can be seen from tests 6 and 8 the fertilizer yield follows the same proportionately.

FIG. 5 is drawn from a large piece of shale, delaminated in the manner of the invention, showing three faces. The delaminations DL occur along flat bedding planes parallel to the opposed faces F1 and F2. The organic content appears to be highest along these boundaries. The delaminations are extensive, commencing at one end or edge. The delaminations of the shale fragment shown in FIG. 5 are extremely flexible and can be easily spread, split or separated by slight digital force but as mentioned above the resultant subdivisions, of thinner planar characteristic retain substantially the original mechanical property of crush resistance.

In the course of experimental work erratic results were sometimes encountered, from merely good to very good. There was no explanation until manometer tests suggested a degree of out-gassing inversely proportioned to the time (age) the crushed shale lay idle.

Freshly crushed shale samples were subjected to accelerated aging conditions by pre-heating the samples of a given batch at different temperatures and pressures: increased pre-heat is equivalent to accelerated aging. Applied vacuum also results in accelerated out-gassing. The data in Table 5, collected during the testing when the data for Table 4 were collected, show that indeed the kerogen yield declines with "age". As in the instance of the other tests (Table 4) kerogen was extracted from 500 gram samples; boiling perchlorethylene was employed at atmospheric pressure.

Table 5

| Test No. | Prior Aging Condition | Subsequent Kerogen Extract |
|---|---|---|
| 1 | Pre-heat shale to 300° F | 8 grams |
| 2 | Pre-heat shale at 400° F and apply a vacuum while the shale is hot | 1 gram |
| 7 | Pre-heat shale at 625° F (no vacuum) | 1.3 grams |

The data in Table 5 concerned with "aging" can be explained as follows. The shale contains internally trapped moisture and other volatiles, entrained since creation of the shale deposit. When the shale is crushed and allowed to stand (age) the entrained volatiles escape; the smaller the particle, the greater the rate of out-gassing, and the greater the age the less volatile retained.

When a batch of crushed shale, after standing for several weeks (or even days) is subjected to extraction, there is a diminution of entrained volatile content for aiding the delamination process, that is, the partial pressure of $H_2O$ for example would exert its own influence internally, rupturing the shale granule and exposing more surface area to the influence of the solvent, and to the infuence of the leach water.

The evolved pressures due to out-gassing have been measured as being of the order of $\frac{1}{8}$ to $\frac{1}{4}$ pound per square inch, perhaps higher. While the forces are relatively small, they are apparently responsible in cooperation with solvent action for producing delamination on an increasing scale with increasing temperature (or with increasing gauge pressure which amounts to the same thing) during solvent extraction and water leaching. At 320° F. for example, the internal action due to partial pressure of $H_2O$ results in an inter-laminar force of nearly sixteen pounds within a particle of $\frac{1}{2}$ inch screen size.

Freshly crushed shale should therefore be used. Experiments establish that measurable out-gassing commences after granules of $\frac{1}{4}$ inch screen size stand even for 1 hour under standard conditions; less time for smaller particles, more time for large particles. Optimum time for commencing extraction is within several hours after crushing.

The products obtained under the FIG. 3 process (kerogen, the final dross and the fertilizer) have all the attributes of the FIG. 1 process to a greater degree in terms of yield and also in that fines having agricultural substrate utility are separated from the solvent which contains kerogen.

Nearly all, if not actually all, kerogen extractable by the solvent, may be extracted, substantially in unreacted or unconverted form, especially if the residue retains sufficient (unreacted) inorganic or fertilizer value to serve as a local land restorative. If the residue is used as land fill it is superior to what was taken from the earth because of its porosity which serves to adsorb both water and air essential to plant growth.

The process may be applied to extracting the organic content (bitumens) from natural tar sand deposits, leaving a clean sand residue environmentally superior to the deposit. Thus, many of the objectives listed above can be equally achieved in terms of low temperature, low pressure solvent extraction of tar sand bitumens.

The disclosure which follows concerns practices applicable to recovery of at least two useful products from both oil shale and tar sand: an organic product (kerogen or bitumen) containing petroleum fractions, and a residue (porous shale or sand particles, as the case may be) of arable quality or sufficiently devoid of environmentally unacceptable chemicals to be useful as land fill.

The phenomona of oil shale extraction will not be repeated since the principles are the same, except to note that while the oil shale needs to be finely divided this is not necessarily so with tar sand. The solvents listed above are so potent they are capable of thoroughly penetrating fist-size chunks of tar sand and hence it is only necessary to start with chunks of tar sand.

Tar sands rich in bitumens that are readily convertible to petroleum products are found in substantial quantities throughout the world. Hard sand deposits in Utah are estimated to contain 18–28 billion barrels of petroleum. The softer Athabaska deposits in Alberta, Canada are said to contain up to 700 billion barrels of petroleum.

Tar sands differ in physical properties and bitumen makeup. The Athabaska sands are relatively soft and almost tar-like while the Utah sands are quite hard and resistent to fracturing.

Processes have been devised to separate bitumens from tar sand. These processes generally involve the use of water and steam or recycled petroleum solvents; in many cases both. Water is subjected to polluting factors and recovery is minimal. The high latent heat of water can impose a low thermal and net energy recovery efficiency on the process.

Petroleum solvents such as kerosene or gasoline are effective in the extraction of bitumens from tar sands. There are, however, problems of considerable order associated with processes using such solvents. Safety hazards are involved. Also, the sand has an affinity for hyrocarbon solvents, so the sand-like residue is left coated with a film of petroleum solvent and bitumen representing both a loss of yield and an unfavorable environmental influence. The residue is environmentally objectionable and has little or no arable value.

The objects of the present invention in terms of tar sand deposits are to extract the bitumen content by a low temperature process involving a non-hydrocarbon or non-petroleum solvent applied in two steps, first to dissolve the bitumen and thereafter as a rinse to remove any adherent bitumen, not only to increase the yield but also to result in clean sand particles having utility; to employ a solvent having low affinity for (adherence to) sand particles stripped of bitumen; to be able to extract a fertilizer constituent from the sand; to produce a sand residue not containing high temperature reacted organic or inorganic compounds; to not only restore the environment but to be able to create a better environment in the area surrounding the deposit; to conduct the recovery processes in a closed system characterized by little energy waste and no objectionable alteration in the environment and to apply those same principles to the processing of oil shale.

The present process generally involves subjecting coarsely comminuted tar sand to the action of a non-petroleum solvent. A preferred solvent is perchloroethylene (non-hydrocarbon) operating at pressures in the 0–20 PSIG (250°–325° F.) range. The solvent action rapidly breaks up the sand matrix and dissolves the bitumens. This is followed by a rinse with clean recycled solvent which serves to strip the surface of the loose extracted sand particles, recovering residual surface bitumens and rendering the sand particles clean and water wettable.

A closed system is used to insure the total recovery of the solvent. The solvent-bitumen solution is pumped from an extraction chamber into a still where the bitumen is recovered as a concentrate; the distilled solvent vapor is recycled to the extraction chamber and condensed on the incoming tar sand. The clean extracted sand is removed from the extraction chamber for further processing.

A more expanded statement of the process involves the following steps:

A. Dividing the natural tar sand deposit to a degree suitable for solvent extraction;

B. Subjecting the divided fraction to the action of hot (condensing) solvent vapor to dissolve bitumen, followed by boiling solvent (mechanical action) later applied to increase the extraction rate;

C. Transferring the resulting solvent-bitumen solution to a fractionating still and returning the distilled solvent to the system;

D. Employing a portion of the distilled solvent to rinse residual adherent bitumen from the sand, from which the major bitumen content has been extracted, to produce a clean sand dross or residue;

E. Removing the dross sand residue for further processing or end use;

F. Retaining solvent heat of vaporization within the system by recycling the distilled solvent vapor to the extraction chamber and on to the incoming cold tar sand, initiating the extraction process;

G. Retaining extracted sand heat energy within the system through the use of heat exchange between incoming cool tar sand and outgoing warm extracted sand;

H. Recovering residue carry-over solvent from tar concentrate and extracted sand using thin layer, or vacuum evaporation, and recycling the recovered solvent to the system.

Tar sands have been found to contain substantial quantities of phosphate (analyzed as $P_{205}$) and potash (analyzed as $K_2O$) materials apparently in loose chemical bond to the surface of the silicate sand matrix.

These fertilizer values are water soluble but are not soluble in a bitumen solvent at temperatures below the organic-inorganic reaction point (about 200° C.). The selective removal of the bitumens and rinsing of the sands under the present invention leaves the fertilizer constituent intact for subsequent water extraction; or the clean sand dross may be restored to the site or transported elsewhere as a land fill or an industrial product.

Further processing steps intended to selectively recover these phosphate and potash minerals (fertilizer constituents) involve the following:

I. Subjecting the clean sand dross to the action of hot water to extract a fertilizer constituent;

J. Transferring the resulting water-mineral solution to a gractionating still and returning the distilled water to the fertilizer extractor;

K. Removing the dross sand residue from the fertilizer extractor for use as a land restoration means or for use in connection with compounding fertilizer and soil conditioning materials; and L. Retaining solvent heat of vaporization and extracted sand heat energy within the system.

With little modification, principally in terms of the size of the starting material, the process described is applicable to the non-reactive recovery of unconverted kerogens from oil shale. The thermal energy recovery is a major consideration in this connection since calculations show that only a small percentage (about 3%) of the energy equivalent of the oil in the extracted organic is required to conduct the process.

Figure 6:
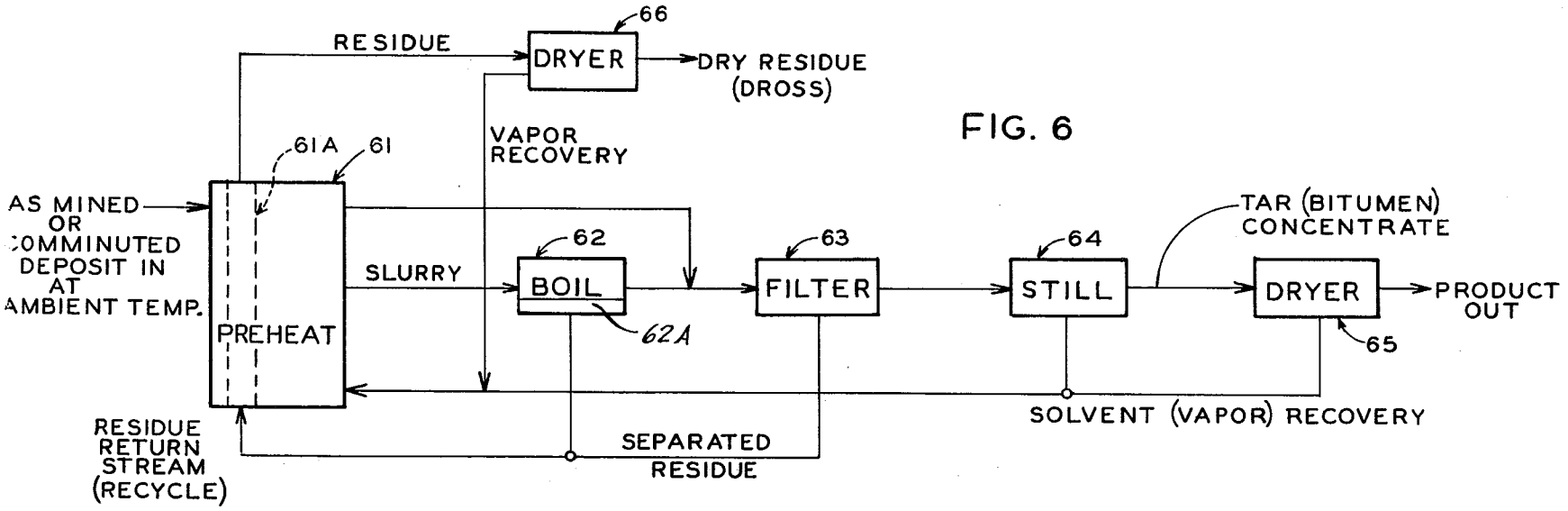
FIGS. 6 and 7 are flow charts applicable to both oil shale and tar sand.

One form of the process is shown in FIG. 6. Tar sand (ore) generally as mined is introduced into a preheat extraction changer 61. Here, the incoming tar sand is preheated by sand residue, previously subjected to extraction, by means of heat exchanger 61A. This residue, when withdrawn, leaves chamber 61 in a cooled state, that is, its heat content is being returned to the system.

Pure distilled solvent is returned to chamber 61 where it condenses on the incoming deposit. This represents the commencement of bitumen extraction from the sand matrix; the heat of vaporization is returned. The solvent may be and preferably is perchloroethylene ($C_2Cl_4$) having a boiling point of 250° F. This solvent is preferred not only because of its powerful solvent action, but also because its latent heat of vaporization is low (only 90 BTU per pound) meaning low caloric input. However, other solvents may be used including trichloroethylene, $CHClCCl_2$. Petroleum solvents are completely unacceptable; they cling to the sand (or shale) residue and in most of those areas where the process would be used there is not enough water to accomplish the job. Besides, the water is then poisoned.

The first overflow of solvent-tar sand (bitumen) solution is fed to a filter 63 and from there to a still 64; the remaining solvent-tar sand slurry is fed to a final extractor 62 where it is subjected to the action of the boiling solvent. Here, further extraction is encouraged due to the increased temperature and mechanical agitation.

The boiling extractor includes a settling chamber 62A where a large portion (but not necessarily all) of the sand residue is removed and fed to the sand return stream.

The overflow from extractor 62 (containing solvent-sand tar solution) is fed to a filter 63, along with the first overflow as already mentioned, where entrained sand may be removed and delivered to the sand return stream. The separated solvent phase is delivered from filter unit 63 to the reducing still 64 where pure solvent is recovered as distillate vapor and returned to the preheat chamber 61.

Recovered bitumen ("process oil") containing some residual solvent is fed from the still to a thin film (evaporative) dryer 65 where the remaining solvent is removed and returned as vapor to the vapor recovery stream. Cool process tar, generally refered to as asphatines, is recovered as a commercial product.

Extracted sand (residue return stream) from the heat exchanger 61A is fed to a dryer 66 where any residual (entrained, not adsorbed) solvent is removed and returned to the vapor recovery stream; clean, water wettable sand is recovered which can be restored to the site in-situ, or shipped elsewhere as an agronomy soil conditioner or further extracted with water to recover any water soluble phosphorus and potassium fertilizer constituents.

Figure 7:
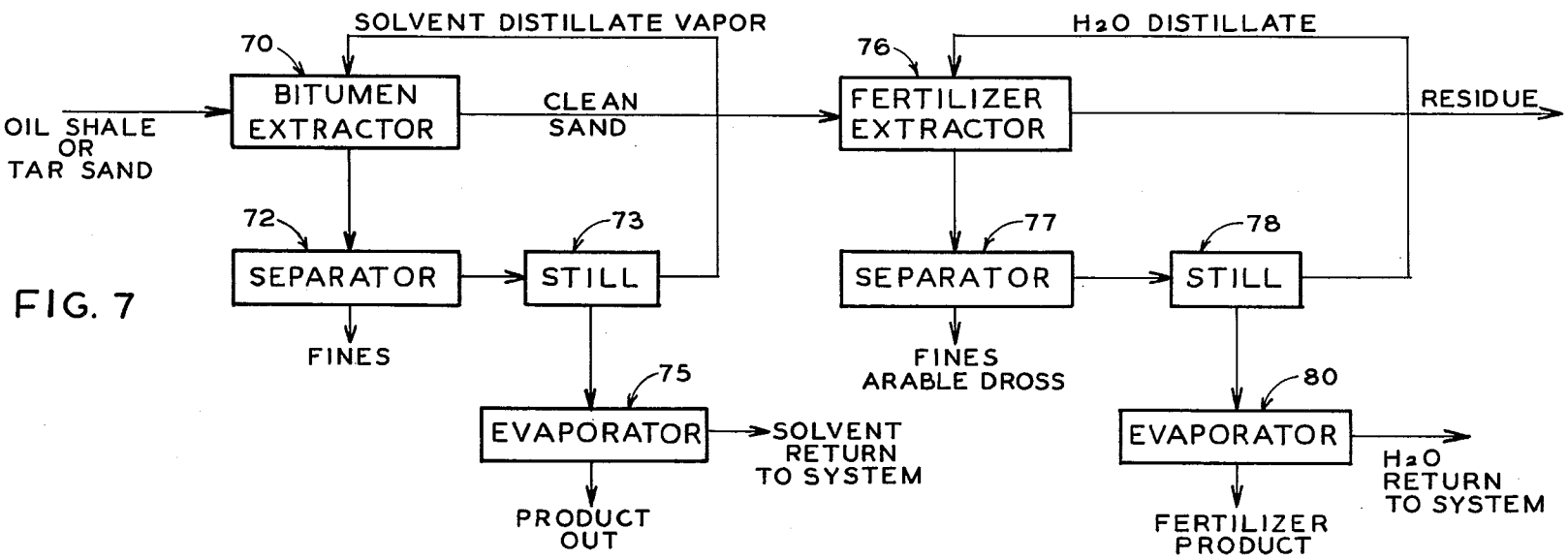

Another system is shown in FIG. 7. The coarse tar sand is introduced into an extractor chamber 70. It first moves through a vapor zone where it is contacted by recycled distilled solvent vapor and then moves through a hot liquid solvent zone as disclosed above. The time of exposure to vapor should be such that the body of sand is at or near the condensation temperature of the liquid solvent. During this time, some bitumen is stripped in connection with the solvent action on the tar sand matrix. Final tar extraction and reduction of the matrix to loose sand particles is completed in the hot liquid solvent phase inside extractor 70.

The time for bitumen extraction will vary, dependent on such factors as the type of solvent, the quality and quantity of sand being processed and the pressure inside the extractor chamber. High pressures are purposely avoided because of excessive temperature and cost but mild pressure up to 20 PSIG may be exerted. In any event, the bitumen is completely extracted.

Typical extraction times have been found to be of the order of 30 minutes when the tar sand is contacted with solvent vapor and hot liquid solvent at atmospheric pressure. Extraction proceeds more rapidly under moderate pressure-temperature conditions. Also solution agitation resulting from solvent boiling contributes to the rapid breakdown of the tar sand matrix and solvent action.

Sand free solvent containing the bitumen extract is delivered from the extractor 70 for concentration. Preferably, any entrained fines are separated by filtration or centrifugally at stage 72. These fines may be scrubbed with more solvent, if deemed necessary, or may be deemed clean enough or sufficiently innocuous to be employed as land fill.

After stage 72, the solution is delivered to a still 73 where the solvent for the most part is distilled and returned to extractor 70. The remaining concentrated solution is transferred to an evaporator stage 75 where one or more evaporating processes may be applied to obtain the bitumen product which may be further processed for separation of petroleum fractions or derivatives. Residual evaporated solvent is returned to the system.

At no time during extraction of the bitumen, nor subsequently under either system, is the sand to be subjected to a temperature in excess of 350° F. This assures there is no possibility that the sand will attain a temperature where entrained precursors of hazardous compounds, inimical to health, are reacted to produce those compounds, such as carcinogenics.

The present process (any of the systems disclosed) is also characterized in part by production of a clean sand residue, devoid (for all practical purposes) of adherent bitumens and certainly devoid of a petroleum solvent rinse since none is used. Therefore, to strip any retained bitumen, the body of sand may be moved from the hot solvent and transferred to a rinse chamber inside extractor 70 where it is exposed to the further action of distilled vapor solvent vapor. The rinse may also be accomplished by a portion of condensed liquid solvent recirculated from the still 73.

The clean sand residue (dross) resulting from the rinse may be used as land fill since it is clean and very low in high temperature reacted compounds.

The onset of conversion of tars, kerogens and other bitumens has been determined to be very close to 200° C. Such conversion to higher petroleum fractions would be acceptable or even desirable if environmental considerations were not involved. However high temperature conversion or hydrocarbon digestion in the presence of inorganic materials, including silicates and carbonates, can result in the production of inimical biologically active compounds of the type referred to in the aforementioned National Science Foundation report.

However, most tar sands have been analyzed as containing fertilizer values, either a phosphate constituent or a potash constituent or both. These fertilizer values are water soluble. They are entrained on the clean extracted sand particles following the final solvent rinse step because they are not soluble in the solvents disclosed herein.

Therefore, as shown in the drawing, FIG. 7, the body of rinsed sand may be subjected to a second extraction at 76 where the water soluble fertilizer values are extracted by immersion in a body of hot water. The fertilizer solution is separated from any entrained sand at separator 77. Any entrained fines are further separated or filtered. This principle may be applied to FIG. 6 as well.

In any event the fertilizer solution obtained at extractor 77 is distilled at a still 78 to remove the water, leaving a fertilizer concentrate which may be further concentrated at an evaporator 80. Distilled water is recirculated to extractor 76. Heat of condensation is retained within the system by allowing the water vapor to condense on the incoming sand. The arable sand residue, delivered from extractor 70, will vary in arable quality (in the sense of plant nutrient value) depending on the nature of the deposit and the degree of water leach extraction which is possible. In some regions it may not be desirable to extract all the fertilizer values but rather to employ the sand for its enriched value as an environmental restorative, arable medium. In other regions there will be more advantage to extracting all the fertilizer constituents in a practical sense, using the residue as a soil conditioner to create an environment of superior water permeability compared to the original deposit or surrounding area.

The sand is of a generally fine granular state, both during bitumen separation in extraction chamber 70 and during the fertilizer leach in extraction chamber 76. If the deposit is not naturally granular, like the Athabaska deposits, but is hard and stony, then it must be comminuted prior to being exposed to the solvent.

The process systems of FIGS. 6 and 7 are susceptible to being arranged in an advantageous unique energy loop, enabling thermal energy which would otherwise be lost to be recycled. Basically, two principles are involved: (1) to contain (heat exchange) to heat of vaporization of the solvent in a system which uses distillation to separate a solvent from solvent-extracted material obtained from a starting substance or raw material which also contains a dross or residue; (2) employing that residue, resulting from extraction, in a heat exchange relation, that is, containing its heat within the system by heat exchange between the entering raw material and the (hot) residue.

The principles involved are shown in FIGS. 8 and 9, applicable to both oil shale and tar sand, designated raw material. The extractor 100 is an upright column heated at the bottom by a source of heat 102. A large coaxial conveyor screw 104 turns inside a coaxial sleeve 106 which is open at both ends.

The sleeve 106 is concentrically spaced inward of the extractor housing so as to define an outer chamber 108 into which the raw material is fed. The top of chamber 108 is closed by a collar 110 but the bottom is open.

Solvent in vapor form is returned from the still and is admitted to chamber 108 through a pipe 190, where it condenses on the raw material, releasing the heat of vaporization as recycle heat. The condensing solvent commences to extract (dissolve) the soluble organic material and as this action continues the raw material, leaner and leaner in terms of extractable (finally becoming pure residue in the boiling zone) moves by gravity to the bottom of the inner sleeve where it forms a slurry as noted in FIG. 8. The slurry is a boiling mixture of the inorganic residue and the organic extractables in solution.

Part of this slurry exits through a take-off pipe 112, being slurry delivered to a filter and then to a still. At the still, as already described, the solvent is recovered and is returned through pipe 109.

Part of the slurry is raised to the top of the extractor by the screw 104 working inside sleeve 106 and in doing so some of its heat is given up to the counter-flowing raw material moving downward in the outer chamber 108. Solvent entrained on the residue drains back to the slurry.

At the top of the extractor, the residue is delivered to a take-off pipe 114 which delivers it to an extractor where any residual solvent is removed, whereafter fertilizer constituents may be extracted by water as already described.

Provision may be made to introduce distilled solvent at the head or top of the extractor to provide a final rinse.

Chamber 108 thus combines a pre-heat chamber, where the raw material is heated both by the condensing solvent and the counter-flow residue, and a primary extraction chamber at the bottom where boiling takes place. Extraction commences, of course, in the pre-heat chamber, and continues as the raw material moves by gravity to the primary extraction chamber.

The thermal loop may be readily seen in FIG. 9. The heat exchange zone and feed rates may be adjusted to provide maximum retention of thermal energy, discharging a dross near ambient temperature and conserving (returning) the heat required for vaporization at the separation still.

Of particular importance in all the systems disclosed is that potassium salts are not swept out with the dissolved kerogen or bitumen but rather are retained by the residue from which the salts, having fertilizer value, may be dissolved with water. Potassium is a notorious poisoner of catalysts employed to "crack" petroleum oils and of course the organic extractables in oil shale and tar sand obtained under the present invention are a potential source of petroleum.

I claim:

1. The process of treating oil shale, reduced to particulate granular form, to produce at least two usable products, one being an unconverted organic extract principally kerogen which contains shale oil and the other a dross suitable as an agricultural substrate, comprising the following steps:

A. Treating the particulate shale with a hot perchloroethylene solvent in which kerogen is soluble at a temperature below 350° F. and at a temperature of not more than about 350° F. for a time sufficient to extract a substantial kerogenous fraction from the particulate shale without converting any appreciable part of the kerogen while leaving an unextracted inorganic residue in the particulate shale having a water soluble fertilizer constituent selected from the group consisting of nitrates, phosphates, potash and water soluble trace minerals;

B. Separating the kerogenous fraction and solvent from the treated particulate shale, leaving a granular dross in the form of a granular water-permeable substrate material which will support plant life;

C. Distilling said fraction and solvent to separate said fraction leaving the solvent in substantially pure form which is recycled to step A; and D. At least partly separating the fertilizer constituent from the granular dross.

2. A process according to claim 1 in which step A is conducted at a pressure above atmospheric and in which the granular dross is employed as land fill at the site where the process is conducted.

3. A process according to claim 1 in which the particulate shale is boiled by immersion in the hot solvent, drained and then reimmersed in the hot solvent.

4. A process according to claim 1 in which the body of extracted kerogen and solvent includes the water soluble fertilizer constituent, and including the step of separating that constituent.

5. A process according to claim 1 including the steps of separating any entrained shale fines in the solvent containing the kerogenous fraction and combining those fines with said granular dross to afford a granular agricultural substrate.

6. A process according to claim 1 in which the shale is employed within several hours after after reduction to granular form.

7. A process according to claim 2 in which the shale is employed within several hours after reducing the shale to granular form.

8. The process of treating oil shale, reduced to particulate granular form, to produce at least two usable products, one being an unconverted organic extract principally kerogen which contains shale oil and the other a dross suitable as an agricultural substrate, comprising the following steps:

A. Treating the particulate shale with a hot solvent in which kerogen is soluble at a temperature below 350° F. and at a temperature of not more than about 350° F. for a time sufficient to extract a substantial kerogenous fraction from the particulate shale without converting any appreciable part of the kerogen while leaving an unextracted inorganic residue in the particulate shale having a fertilizer constituent selected from the group consisting of nitrates, phosphates, potash and water soluble trace minerals;

B. Separating the kerogenous fraction and solvent from the treated particulate shale, leaving a granular dross in the form of a granular water-permeable substrate material which will support plant life; at least partly separating the fertilizer constituent from the granular dross, and C. Distilling said kerogenous fraction and solvent to separate said fraction while leaving the solvent in substantially pure form which is recycled to step A.

9. A process according to claim 8 in which the solvent is perchloroethylene.

10. A process according to claim 8 in which the body of extracted kerogen and solvent includes a water soluble fertilizer constituent, and including the step of separating that constituent.

11. A process according to claim 8 in which the solvent for the kerogen is perchloroethylene and in which the fertilizer constituent is separated by leaching with hot water.

12. A process according to claim 1 in which the granular dross from step B, while hot, is employed in heat exchange relation with the particulate shale to be treated with the solvent.

13. A process according to claim 3 in which the particulate shale before being boiled is first heated in hot solvent vapor.

14. A process according to claim 3 in which the granular dross from step B, while hot, is employed in heat exchange relation with the particulate shale to be treated with the solvent.

15. A process according to claim 8 in which the particulate shale is sequentially immersed in hot solvent vapor and boiling vapor, followed by draining the solvent from the particulate shale.

16. A process according to claim 8 in which the granular dross is employed in heat exchange relation with the particulate shale to be treated by the solvent.

17. A process of recovering several useful products including bitumen from a tar sand deposit which includes a water soluble phosphorus and/or a potassium fertilizer constituent, said process comprising:

A. Transferring a fraction of the deposit to an extraction chamber and there subjecting that fraction to the solvent action of a hot solvent to dissolve into solution substantially all the bitumen content, at a temperature less than about 350° F., while leaving a sand residue, said solvent having a boiling point not more than about 350° F.;

B. Delivering at least part of the solution from step A to a still where the solvent is at least in part distilled, leaving a bitumen concentrate which is recovered as a useful product;

C. Recirculating the distilled solvent to the extraction chamber;

D. Separating and drying said sand residue from which bitumen has been dissolved; and E. Transferring the sand residue to another extraction chamber and there extracting with water a fertilizer constituent retained by said sand residue.

18. A process according to claim 17 including the step of distilling the water solution to recover water and returning recovered water to said other extraction chamber.

19. A process according to claim 18 where the solution containing the bitumen and the solution containing the fertilizer are each processed to remove sand fines.

20. A process according to claim 17 wherein the solvent in said extraction chamber is boiling, said extraction chamber being preceeded by a preheat chamber to which the deposit, as mined, is fed, and including the steps of:

F. Using said sand residue at the preheat chamber for heat exchange with the as-mined deposit; and G. Recirculating the distilled solvent to the preheat chamber and contacting the as-mined sand therewith to commence bitumen solution.

21. A process according to claim 20 including the additional steps of:

H. Withdrawing the sand residue used for heat exchange at the preheat chamber, from which bitumen has been dissolved, evaporating residual solvent from the residue to recover adherent solvent leaving clean, dry sand as a useful product and returning the thus-recovered solvent to the system; and I. Transferring from the preheat chamber to the first-named extraction chamber a slurry stream of sand and solvent containing bitumen.

22. A process for recovering organic content in the form of either bitumen from a tar sand deposit or kerogen from an oil shale deposit comprising:

A. Transferring a fraction of the deposit to an extraction chamber and there subjecting that fraction to the solvent action of a hot perchloroethylene solvent to dissolve at least part of said organic content, while leaving a cleansed principally inorganic residue substantially free of organic content, at a temperature of not more than about 350° F. thereby preventing conversion of the organic and inorganic content to another compound;

B. Delivering at least part of the solution from step A to a still where the solvent is at least in part distilled, leaving the organic constituent which is recovered as a useful product;

C. Said extraction chamber being preceeded by a preheat chamber to which the as-mined deposit is fed;

D. Employing at least a part of the cleansed residue from step A at the preheat chamber for heat exchange with the as-mined deposit; and E. Recirculating distilled solvent to said preheat chamber in contact with the as-mined deposit to commence extraction of the organic constituent.

23. A process according to claim 22 wherein a slurry of the deposit and solvent containing dissolved organic constituent is fed from the first-named extraction chamber, filtered to remove the residue, and distilled to recover the solvent.

24. A process according to claim 23 wherein the residue used for heat exchange in the preheat chamber is withdrawn and dried to recover any attached solvent, and returning the solvent thus recovered.

25. A process according to claim 23 wherein the residue includes a water soluble phosphorus and/or potassium compounds useful as a fertilizer and including step of treating system residue with water to obtain those compounds.

26. A method of processing a tar sand or oil shale raw material, which contains an organic fraction soluble in perchloroethylene as solvent and an insoluble inorganic fraction, to separate and recover both fractions comprising:

A. Contacting the raw material with said perchloroethylene solvent in vapor form, 350° F. maximum, under conditions to condense the solvent which releases its heat of vaporization to the raw material and commences to dissolve the soluble fraction;

B. Transferring the so-contacted raw material to a chamber where the solvent is boiling, resulting in solution of the soluble fraction, and leaving the residue fraction;

C. Employing the residue of step B in heat exchange with the raw material; and

D. Distilling said solution to recover solvent in vapor form and employing the solvent vapor in step A.

27. A process according to claim 26 in which the residue contains a water soluble fertilizer constituent, either a phosphorus or potassium compound, and in which the residue is treated with water to dissolve water soluble constituents carried by the resudue.

28. A process according to claim 27 in which the water solution is evaporated to recover water which is recycled back to the process.

29. A process according to claim 26 in which the residue, after heat exchange, is rinsed with the solvent.

30. A process according to claim 17 in which the tar sand deposit in the extraction chamber is exposed to the solvent in vapor form followed by an immersion in boiling solvent.

31. A process according to claim 17 in which the sand residue, following extraction, is rinsed by solvent to remove any residual bitumen.

32. A process according to claim 17 in which the sand residue has a useful heat content for preheating the deposit fraction and is employed in heat exchange relation with said deposit fraction to be subjected to solvent action.

33. A process of recovering several useful products including bitumen from a tar sand deposit, said deposit also containing a water soluble phosphorus and/or potassium fertilizer constituent, and comprising:

A. Transferring a fraction of the deposit to an extraction chamber and there subjecting that fraction to the solvent action of a hot non-petroleum solvent to dissolve substantially all the bitumen content, at a temperature less than about 350° F., while leaving a sand residue, B. Delivering at least part of the solution from step A to a still where the solvent is at least in part distilled, leaving a bitumen concentrate which is recovered as a useful product;

C. Recirculating the distilled solvent to the extraction chamber; and

D. Transferring the sand residue to another extraction chamber and there extracting with water at least part of the fertilizer constituent retained by said sand residue.

34. A process according to claim 33 including the step of distilling the water solution to recover water and returning recovered water to said other extraction chamber.

35. A process according to claim 33 where the solvent is perchloroethylene.

36. A process according to claim 34 where the solvent is perchloroethylene.

37. A process according to claim 34 where the solution containing the bitumen and the solution containing the fertilizer are each processed to remove sand fines.

38. A process according to claim 33 in which the tar sand deposit in the extraction chamber is exposed to the solvent in vapor form followed by an immersion in boiling solvent.

39. A process according to claim 33 in which the sand residue, following extraction, is rinsed by solvent to remove any residual bitumen.

40. A process according to claim 33 in which the sand residue has a useful heat content for preheating the deposit fraction and is employed in heat exchange relation with said deposit fraction to be subjected to solvent action.

41. A method of processing a tar sand or oil shale raw material, which contains an organic fraction soluble in a solvent and an insoluble inorganic fraction which contains water soluble phosphorus and/or potassium fertilizer constituents to separate and recover both fractions comprising:

A. Contacting the raw material with said solvent in vapor form under conditions to condense the solvent which releases its heat of vaporization to the raw material and commences to dissolve the soluble fraction not above 350° F.;

B. Transferring the so-contacted raw material to a chamber where the solvent is boiling, resulting in solution of the soluble fraction, and leaving the residue fraction;

C. Employing the residue of step B in heat exchange with the raw material;

D. Distilling said solution to recover solvent in vapor form and employing the recovered solvent in step A; and F. Treating the residue with water to produce a water solution of the water soluble fertilizer constituents carried by the residue.

42. A process according to claim 41 in which the water solution is evaporated to recover water which is recycled back to the process.

43. A process according to claim 41 in which the residue, after heat exchange, is rinsed with the solvent.

* * * * *